US007648348B2

(12) United States Patent
Scallen

(10) Patent No.: US 7,648,348 B2
(45) Date of Patent: Jan. 19, 2010

(54) DEWATERING APPARATUS

(76) Inventor: Richard E. Scallen, 8506 N. Hwy. 14/16, Gillette, WY (US) 82716

( * ) Notice: Subject to any disclaimer, the term of this patent is extended or adjusted under 35 U.S.C. 154(b) by 152 days.

(21) Appl. No.: 11/770,609

(22) Filed: Jun. 28, 2007

(65) Prior Publication Data

US 2008/0003121 A1 Jan. 3, 2008

Related U.S. Application Data

(60) Provisional application No. 60/806,054, filed on Jun. 28, 2006, provisional application No. 60/806,251, filed on Jun. 29, 2006.

(51) Int. Cl.
*F04B 35/00* (2006.01)

(52) U.S. Cl. ..... 417/392; 417/554; 417/555.2

(58) Field of Classification Search ..... 417/388, 417/554, 392, 46, 555.2, 460, 904, 468; 166/68, 166/105, 109

See application file for complete search history.

(56) References Cited

U.S. PATENT DOCUMENTS 3,055,764 A * 9/1962 Pryor et al. ..... 166/109
4,137,017 A 1/1979 Lonardo
4,185,655 A 1/1980 Wilkes et al.
4,470,775 A 9/1984 Lonardo
4,565,496 A * 1/1986 Soderberg ..... 417/46
4,591,320 A 5/1986 Pope
4,611,974 A * 9/1986 Holland ..... 417/388
4,923,367 A 5/1990 Zimmer
6,361,272 B1 3/2002 Bassett
6,446,014 B1 9/2002 Ocondi
6,450,256 B2 9/2002 Mones
6,923,275 B2 8/2005 Gardes
7,063,791 B2 6/2006 Miner
7,073,597 B2 7/2006 Williams
7,086,473 B1 8/2006 Bangash
7,134,499 B2 11/2006 Wilson et al.
7,192,517 B2 3/2007 Webb
2004/0035582 A1 2/2004 Zupanick
2005/0265874 A1 12/2005 McClain

* cited by examiner

*Primary Examiner*—Devon C Kramer
*Assistant Examiner*—Todd D Jacobs
(74) *Attorney, Agent, or Firm*—Christopher Wood; Wood & Eisenberg, PLLC

(57) ABSTRACT

A submersible water pump and a dewatering system comprising the submersible pump. The submersible water pump includes a housing and an outer tube. The housing includes a housing dividing wall and a cylinder head having a bore therethrough through which the outer tube fits. The housing is in slidable engagement with the outer tube and the housing dividing wall. The dewatering system with the submersible pump is used to pump water from vertical coal bed methane wells.

4 Claims, 21 Drawing Sheets

DEWATERING APPARATUS

CROSS-REFERENCE TO RELATED APPLICATIONS

This application claims the benefit of priority from U.S. Provisional Patent Application Ser. Nos. 60/806,054 (filed Jun. 28, 2006) and 60/806,251 (filed Jun. 29, 2006).

STATEMENT REGARDING FEDERALLY SPONSORED RESEARCH OR DEVELOPMENT

Not Applicable.

FIELD OF THE INVENTION

This invention relates to dewatering systems for pumping water out of vertical coal-bed methane ("CBM") producing wells.

BACKGROUND OF THE INVENTION

Coal-bed methane is a natural gas extracted from coal seams or adjacent sandstones. In a U.S. Geological Survey Fact Sheet (FS-019-97) published in 1997, it was reported that in the conterminous United States more than 700 trillion cubic feet (TCF) of coal-bed methane exists in place, with perhaps one seventh (i.e., about 100 TCF) economically recoverable with 1997 technology. Commercial production occurs in approximately 10 U.S. basins; the major producing areas are the San Juan, Black Warrior, and Central Appalachian Basins. The exploitation of coal-bed methane is now international with coal-bed gas projects in numerous locations in various countries outside the United States. Methane can be found in coal seams that have not been overly compressed by a large depth of overburden.

Coal seams, particularly at shallow depths, have large internal surface areas that can store large volumes of methane-rich gas; six or seven times as much as a conventional natural gas reservoir of equal rock volume can hold. Since methane-laden coal is found at shallow depths, wells are easy to drill and relatively inexpensive to complete. With greater depth, increased pressure closes fractures (cleats) in the coal, which reduces permeability and the ability of the gas to move through and out of the coal.

Methane bearing coal mined without first extracting the methane gas can give cause to safety and environmental concerns because methane gas is highly flammable and when released into the atmosphere contributes to global warming. According to FS-019-97, methane in the atmosphere has increased at a rate of about 1 percent per year for 15 years prior to the publication of FS-019-97.

Extraction of coal-bed methane, however, carries with it some technological, environmental and worker safety issues and costs. In a conventional natural oil or gas reservoir, for example, methane rich gas lies on top of the oil, which, in turn, lies on top of water. An oil or gas well draws only from the petroleum that is extracted without producing a large volume of water. In contrast, water permeates coal beds, and the resulting water pressure typically traps coal-bed methane within the coal. To produce methane from coal beds, water is typically drawn off to lower the pressure so that methane can flow out of the coal seam and into the well bore and thence to the surface for processing and/or storage, and onward transportation to customers. There is a continuing need for improved dewatering systems for use in coal bed methane wells.

SUMMARY OF THE INVENTION

A coal bed methane submersible water pump and a dewatering system comprising the submersible pump. The submersible water pump includes a housing and an outer tube. The housing includes a housing dividing wall and a cylinder head having a bore therethrough through which the outer tube fits. The housing is in slidable engagement with the outer tube and the housing dividing wall. The dewatering system with the submersible pump is used to pump water from vertical coal bed methane wells.

BRIEF DESCRIPTION OF THE DRAWINGS

Similar reference characters denote corresponding features consistently throughout the attached drawings.

DETAILED DESCRIPTION OF THE INVENTION

This invention relates to dewatering systems for pumping water out of vertical coal-bed methane ("CBM") producing wells. More specifically, the invention is directed to a dewatering system 100, which includes a hydraulic driven down-hole water pump 120 of novel design. It should be understood that while the down-hole pump 120 is designed to pump water to the surface, it can also be used to pump any other fluid of interest such as oil.

Figure 1:
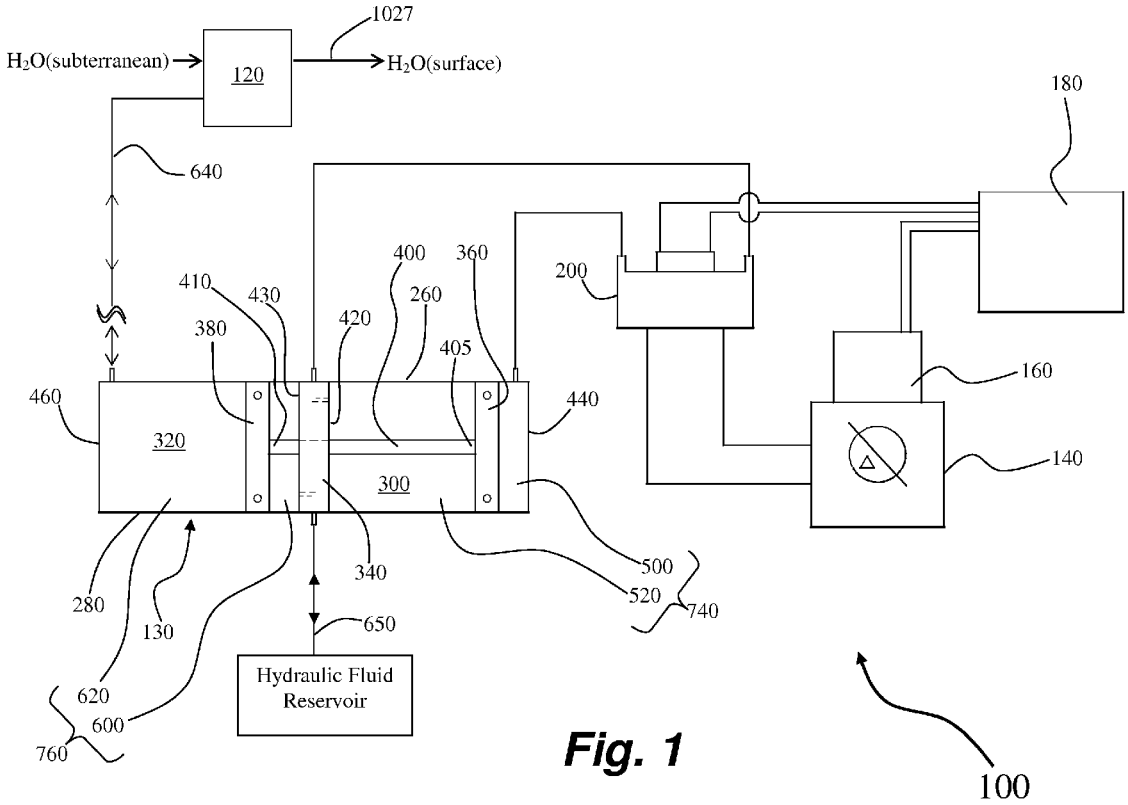
FIGS. 1 through 3 each show a schematic of a dewatering system of the present invention.

Referring to FIG. 1, which shows a schematic of the dewatering system 100 according to one embodiment the present invention, the dewatering system 100 comprises a novel hydraulically driven down-hole water pump 120 (shown in various views in FIGS. 4 through 17), a flow converter 130 (shown in schematic cross section view in, e.g., FIGS. 1 and 2), a hydraulic pump 140, an electric motor 160, a controller 180 such as programmable logic controller, and a two-way hydraulic valve or reversing valve 200. The flow converter 130, a hydraulic pump 140, an electric motor 160, a controller 180, a two-way valve 200 could, for example, be sited on a skid 240 (shown in schematic form in FIG. 2) located on the surface or in a suitable space below ground.

Still referring to FIG. 1, the hydraulic pump 140 is shown using a symbol indicating the pump 140 functions as a unidirectional variable displacement hydraulic pump, wherein two direction flow is achieved using the two-way valve 200 to deliver hydraulic fluid in turn to each side of first piston 360. It will be understood that the two-way valve 200 and one way variable displacement hydraulic pump 140 can be replaced with, for example, a two-way hydraulic pump such as, but not limited to, a two-way variable displacement hydraulic pump 140' (see FIG. 2).

Figure 2:
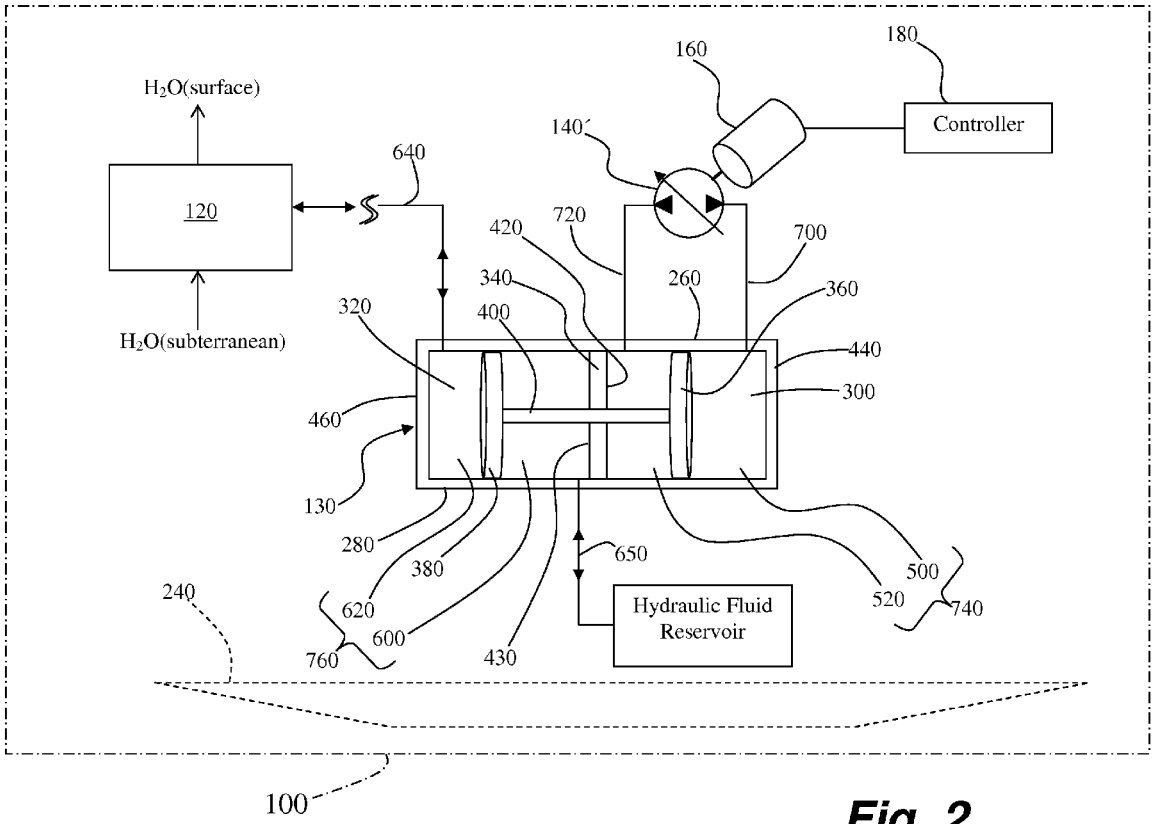

Referring to the schematic diagrams shown in FIGS. 1 and 2, the flow converter 130 has an overall cylindrical shape and comprises first and second horizontally opposed cylinders 260 and 280. The first and second cylinders 260 and 280 define first and second flow converter bores 300 and 320, respectively. The first and second flow converter bores 300 and 320 each have an overall cylindrical shape. The first and second cylinders 260 and 280 are shown separated from each other by a flow converter dividing wall 340. First and second pistons 360 and 380 are disposed in first and second cylinder bores 300 and 320, respectively. The first and second pistons 360 and 380 are interconnected by a common piston rod 400, which passes through the flow converter dividing wall 340. The pistons 360 and 380 are preferably arranged coaxial with respect to each other in their respective cylinders 260 and 280 and interconnected by piston rod 400.

The flow converter dividing wall 340 has first and second opposite sides 420 and 430. First and second cylinders 260 and 280 define opposite base ends 440 and 460, respectively. First piston 360 divides the first cylindrical bore 300 into opposed cylindrical pump chambers 500 and 520. Second piston 380 divides the second cylindrical bore 320 into a non-driving fluid chamber 600 and driving fluid chamber 620. Chambers 500 and 520 collectively define actuator chamber 740, and chambers 600 and 620 collectively define reaction chamber 760. Driving fluid chamber 620 is operably connected to line 640. Line 640 is operably connected to driving fluid chamber 620 and submersible pump 120, and more particularly to upper-chamber 1220 (see, e.g., FIG. 6) inside submersible pump 120.

The common piston rod 400 extends between the reaction and activation chambers 740 and 760 through the flow converter dividing wall 340. The common piston rod 400 having first and second opposite ends 405 and 410, respectively with first and second pistons 360 and 380 respectively attached thereto. The length of the common piston rod 400 is chosen such that when the first piston 360 is aligned proximate to based end 440 then the second piston 380 is aligned proximate to the second side 430 of the flow converter dividing wall 340, and when the second piston 380 is aligned proximate to base end 460 then the first piston 360 is aligned proximate to the first side 420 of the flow converter dividing wall 340. The first and second pistons 360 and 380 reciprocate respectively as a single unit.

In FIG. 2 the hydraulic pump 140' is powered by electric motor 160. Motor 160 is controlled by controller 180. The pump 140' is operably coupled to chambers 500 and 520 via intake and delivery conduits 700 and 720, respectively. The pump 140' can be, for example, an over-center axial piston type wherein flow through lines 700 and 720 may be reversed under direction of controller 180. More specifically, the fluid intake and delivery conduits 700, 720 of pump 140 are connected respectively to cylinder chambers 500 and 520 for delivering and removing hydraulic fluid in a cyclic manner to effect reciprocation of common piston rod 400 and associated first and second pistons 360 and 380. For example, when hydraulic fluid is delivered to chamber 500 this causes piston 360 (and therefore also piston 380) to move towards the first side 420 of flow converter dividing wall 340 thereby forcing hydraulic fluid out of chamber 520 via conduit 720 and conversely when hydraulic fluid is delivered to chamber 520 this causes piston 360 to move towards base end 440 thus forcing out hydraulic fluid out of chamber 500 via conduit 700.

First piston 360 reciprocates inside actuation-chamber 740 in unison, via common piston rod 400, with second piston 380 inside reaction-chamber 760 and visa versa. More specifically, when first piston 360 moves towards the first side 420 of flow converter dividing wall 340 then second piston 380 moves in unison towards based end 460, and conversely when first piston 360 moves towards base end 440 then second piston 380 moves towards the second side 430 of flow converter dividing wall 340. The forced movement of first piston 360 in actuation-chamber 740 produces like movement with respect to the second piston 380 in reaction-chamber 760.

During normal operation of flow converter 130, hydraulic fluid is cyclically driven out of or into driving fluid chamber 620. More specifically, when second piston 380 travels away from second side 430 of flow converter dividing wall 340, and concomitantly travels towards base end 460, the second piston 380 drives hydraulic fluid out of the driving fluid chamber 620 and into line 640; and when second piston 380 travels towards second side 430 of flow converter dividing wall 340 and concomitantly away from base end 460 the second piston 380 drives hydraulic fluid back into the driving fluid chamber 620 from line 640. To avoid creating a vacuum in non-driving fluid chamber 600 hydraulic fluid is passively supplied and removed via line 650. Line 650 operably connects non-driving fluid chamber 600 to a hydraulic fluid reservoir. Though not preferred, in the alternative line 650 can operably connect non-driving fluid chamber 600 to ambient air at the surface.

Figure 3:
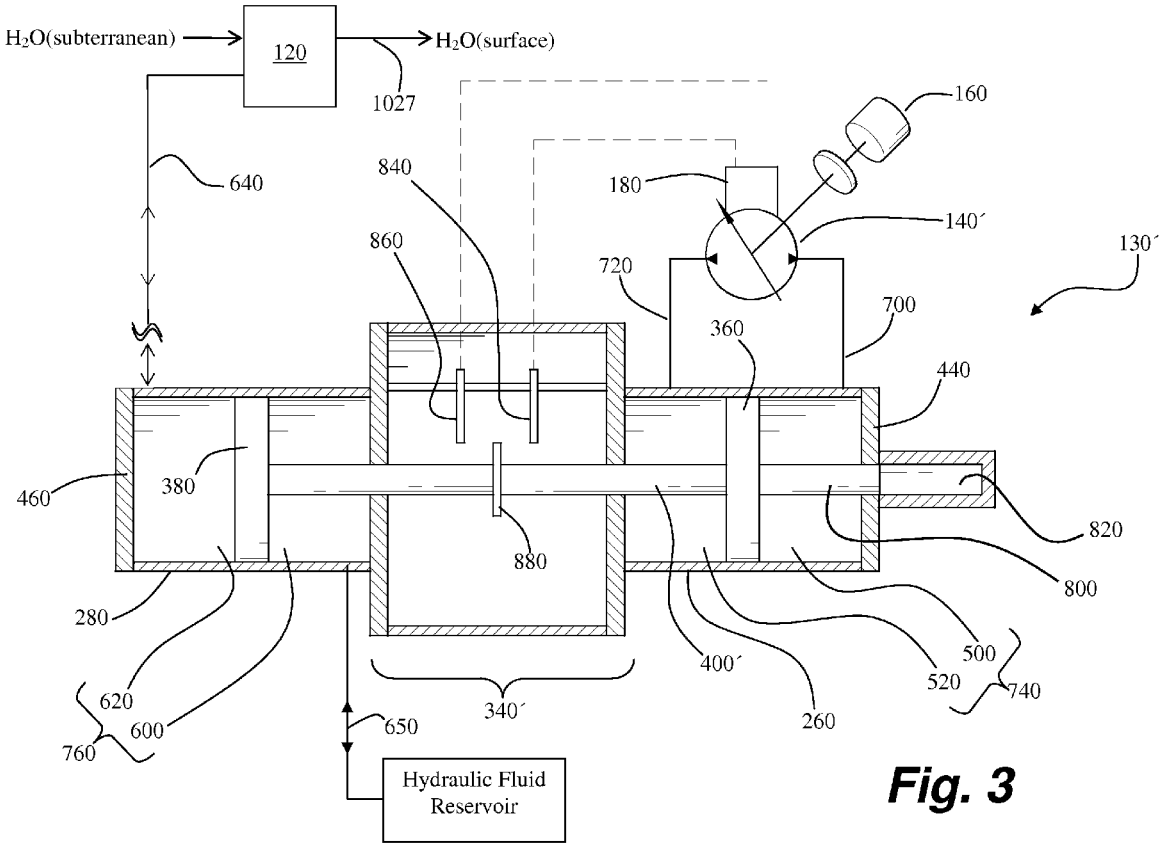

Referring to FIG. 3, it will be understood that the flow converter 130 design can vary so long as it functions to provide recycled hydraulic fluid from the driving fluid chamber 620 back and forth in a controlled manner via line 640 to the upper-chamber 1220 of pump 120. For example, FIG. 3 includes an alternative design for the flow converter 130 (actually represented in FIG. 3 by the numeric label 130'). In this alternative design the piston rod 400 includes an integral extension 800 received in a bore 820 of an extension of the cylinder 260 so that the opposed transverse faces of the piston 360 are of equal axial projected areas.

Still referring to FIG. 3, the flow converter dividing wall 340 (actually represented in FIG. 3 by the numeric label 340') is optionally modified to accommodate a control means such as spaced apart adjustable limit switches 840 and 860 which are engageable, respectively, by an actuator 880 mounted on piston rod 400. The relative positions of switches 840 and 860 may be adjusted to control the stroke length of the pistons 360 and 380 and, accordingly, the stroke of pump 140' by controlling the flow direction of fluid delivered by pump 140' to the respective chambers 500 and 520. Alternatively, the controller 180 may be mechanically interconnected with the piston rod 400 in such a way that, as the piston rod 400 reaches a predetermined limit of a stroke in one direction, the pump controller 180 is actuated to reverse the direction of flow in the pump fluid lines 700 and 720 to reverse the direction of movement of the piston rod 400. It should be noted that the operation of flow converter 130' is similar to the power transfer apparatus described in U.S. Pat. No. 4,611,974 issued Sep. 16, 1986 to Holland. However, the Holland patent does not disclose or suggest the hitherto unknown submersible pump 120 of the present invention or the manner in which the flow converter of the present invention drives the pump 120.

Figure 3A:
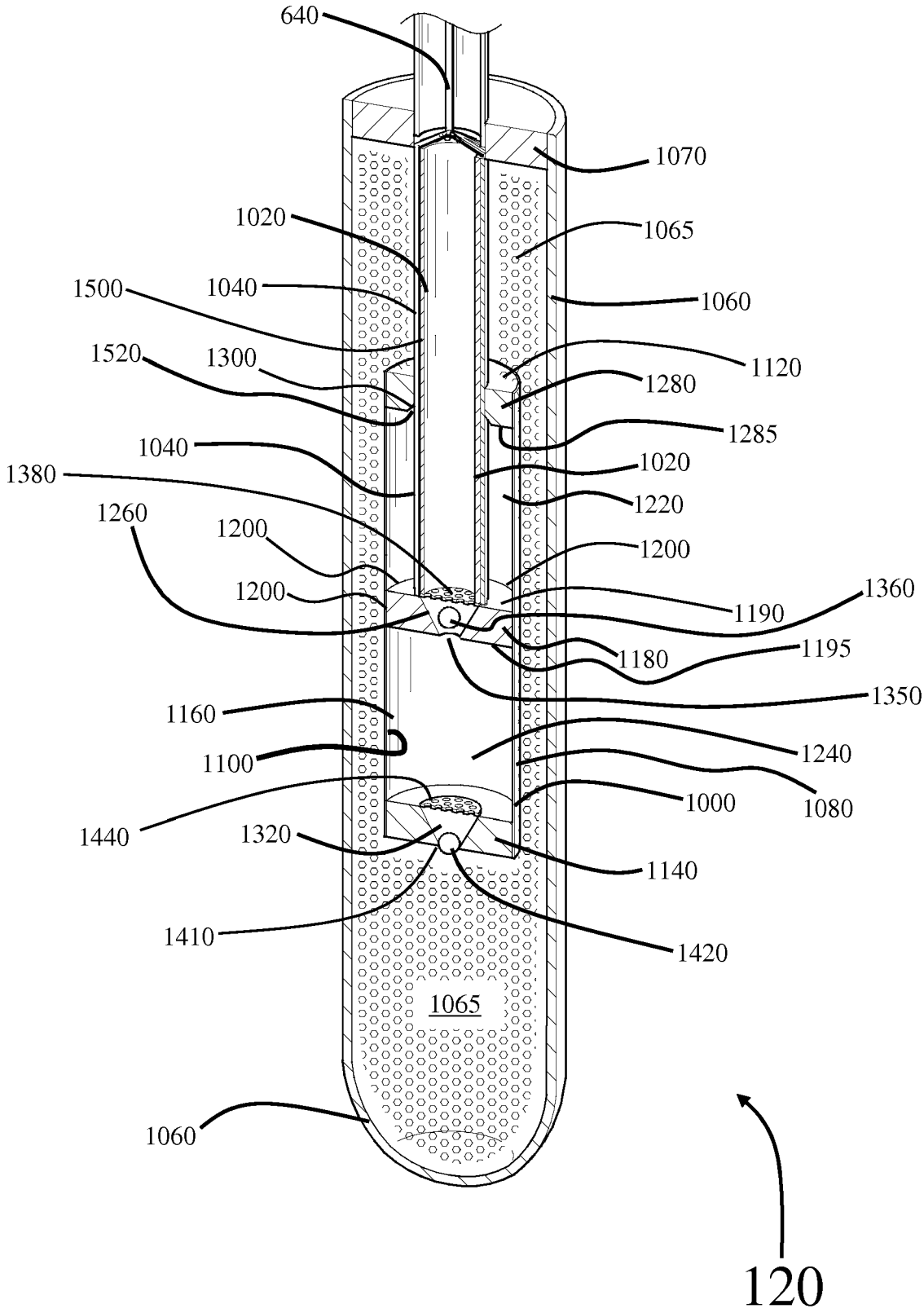
FIG. 3A shows a cross-section schematic along the vertical plane of a down-hole water pump according to the present invention.
Figure 4:
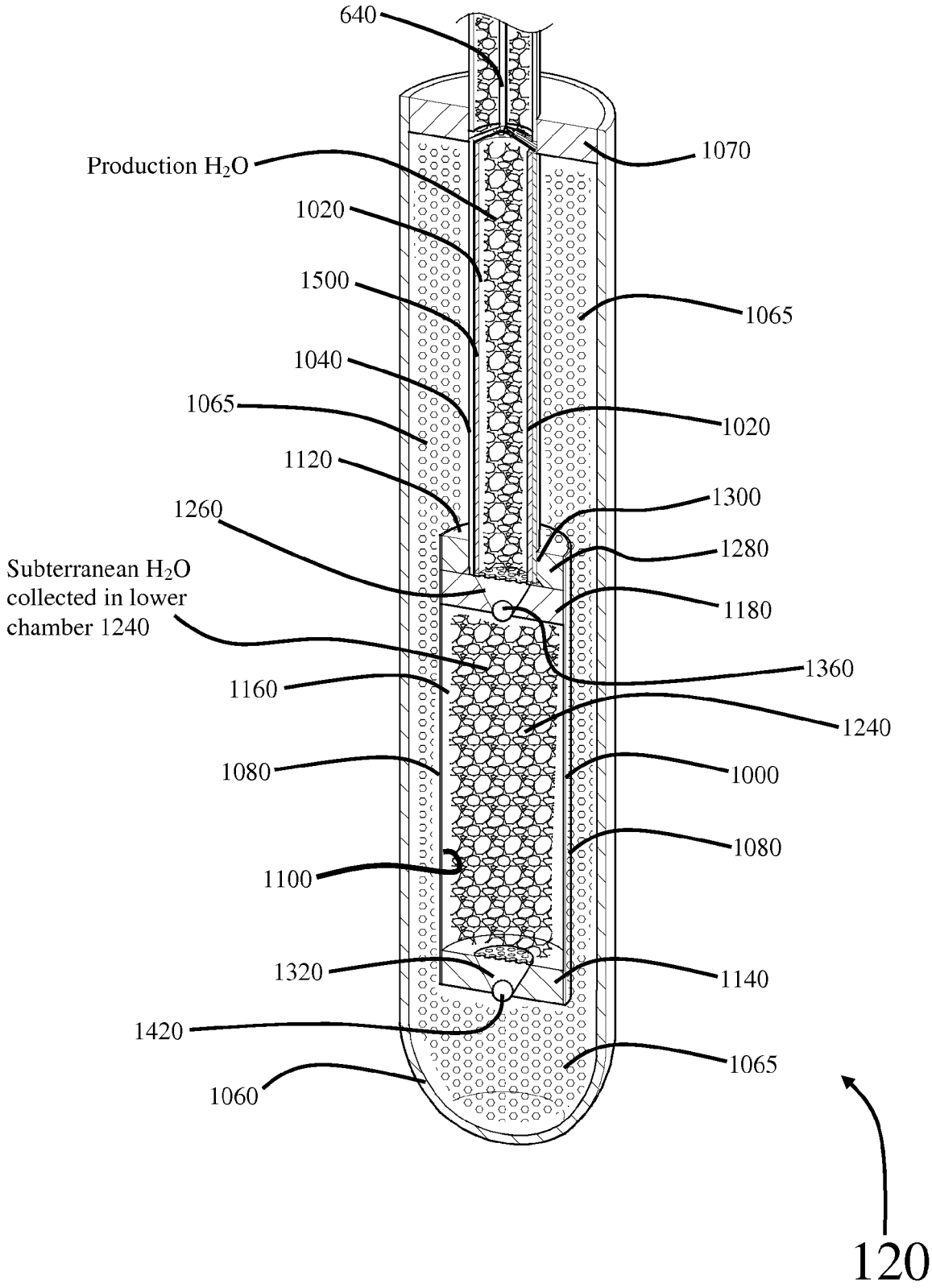
FIG. 4 shows the down-hole water pump of FIG. 3A at 100% down-stroke configuration.
Figure 5:
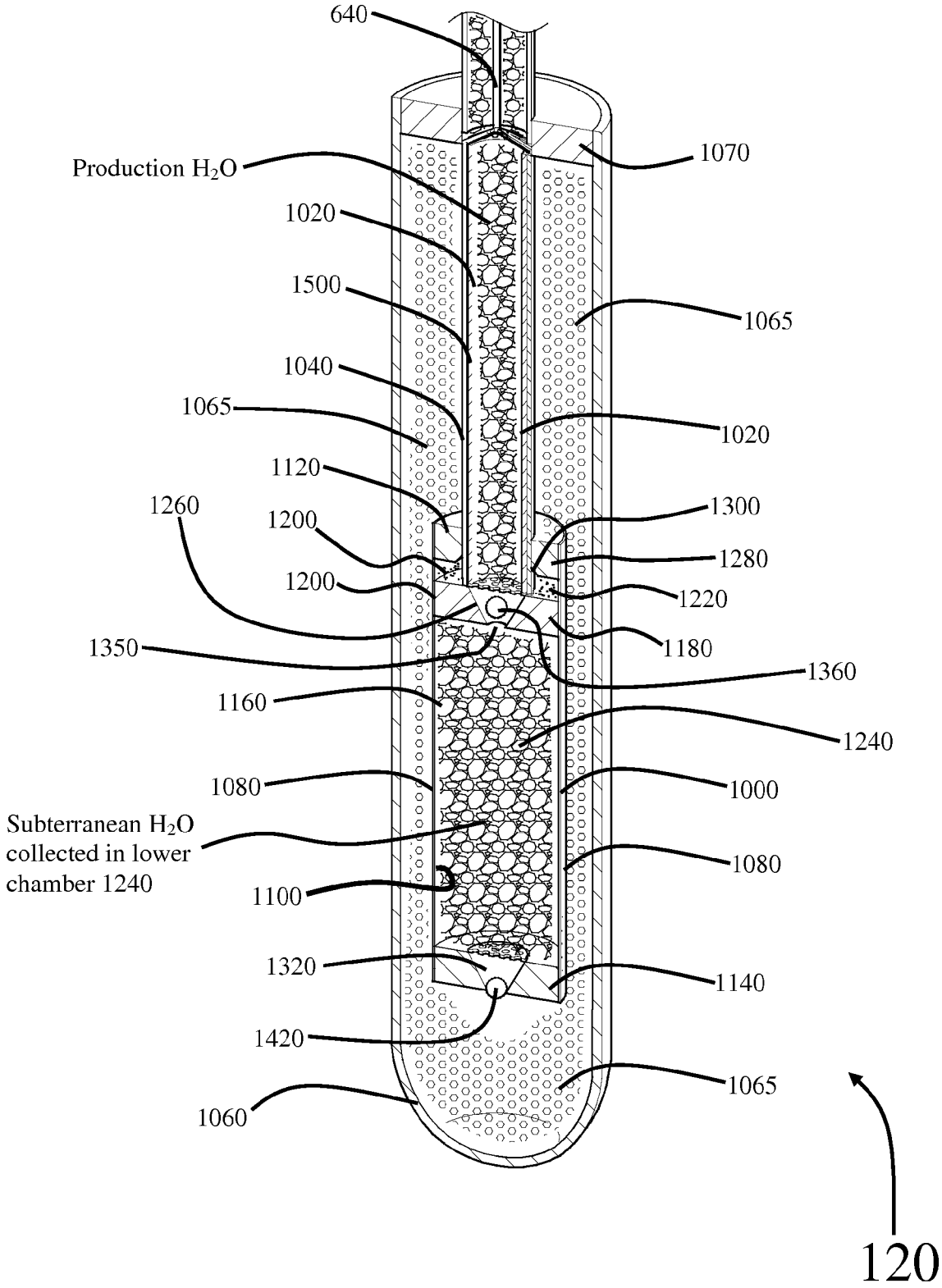
FIG. 5 shows the down-hole water pump of FIG. 3A just after the start of an upstroke.
Figure 6:
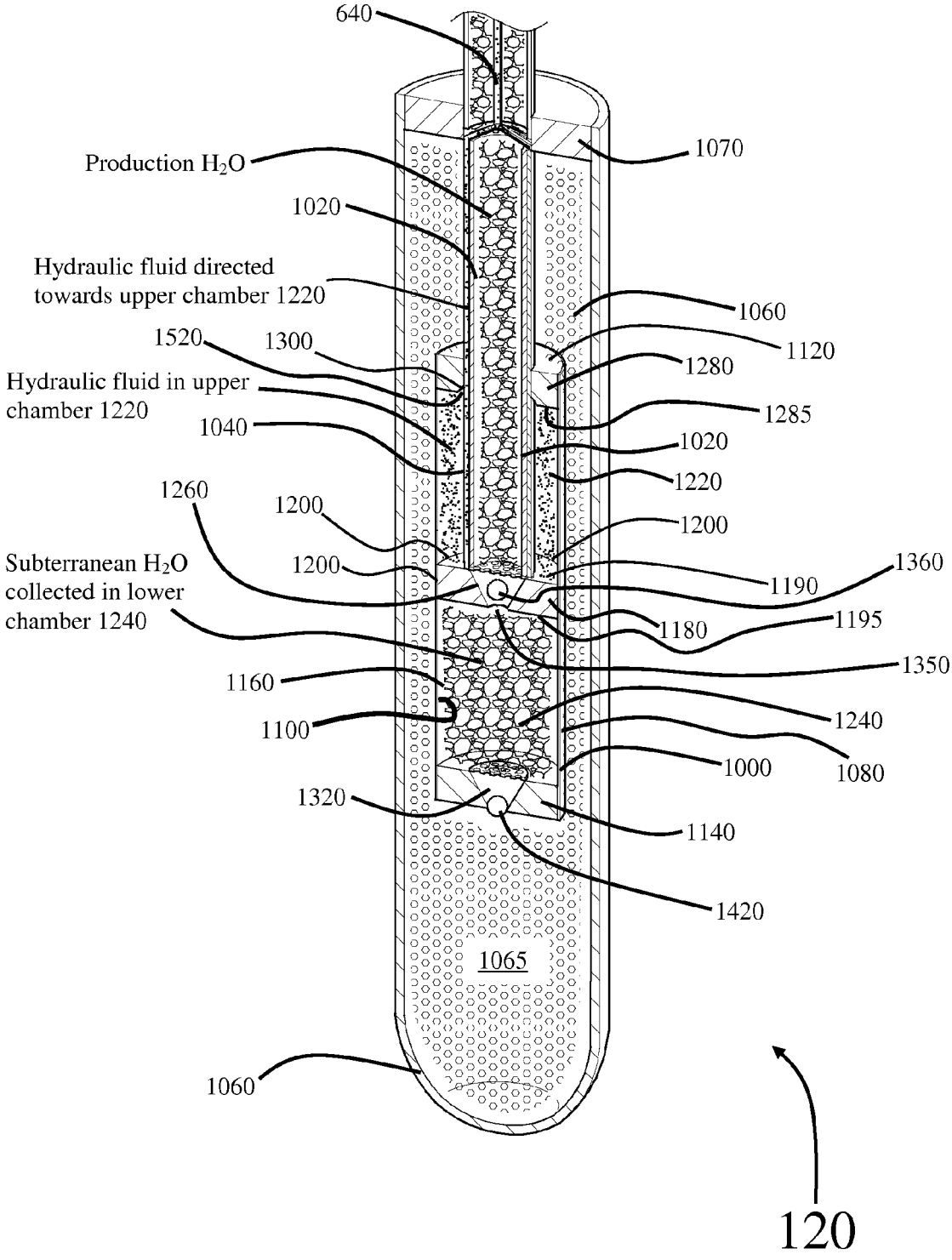
FIG. 6 shows the down-hole water pump of FIG. 3A at 50% completion of an upstroke.
Figure 7:
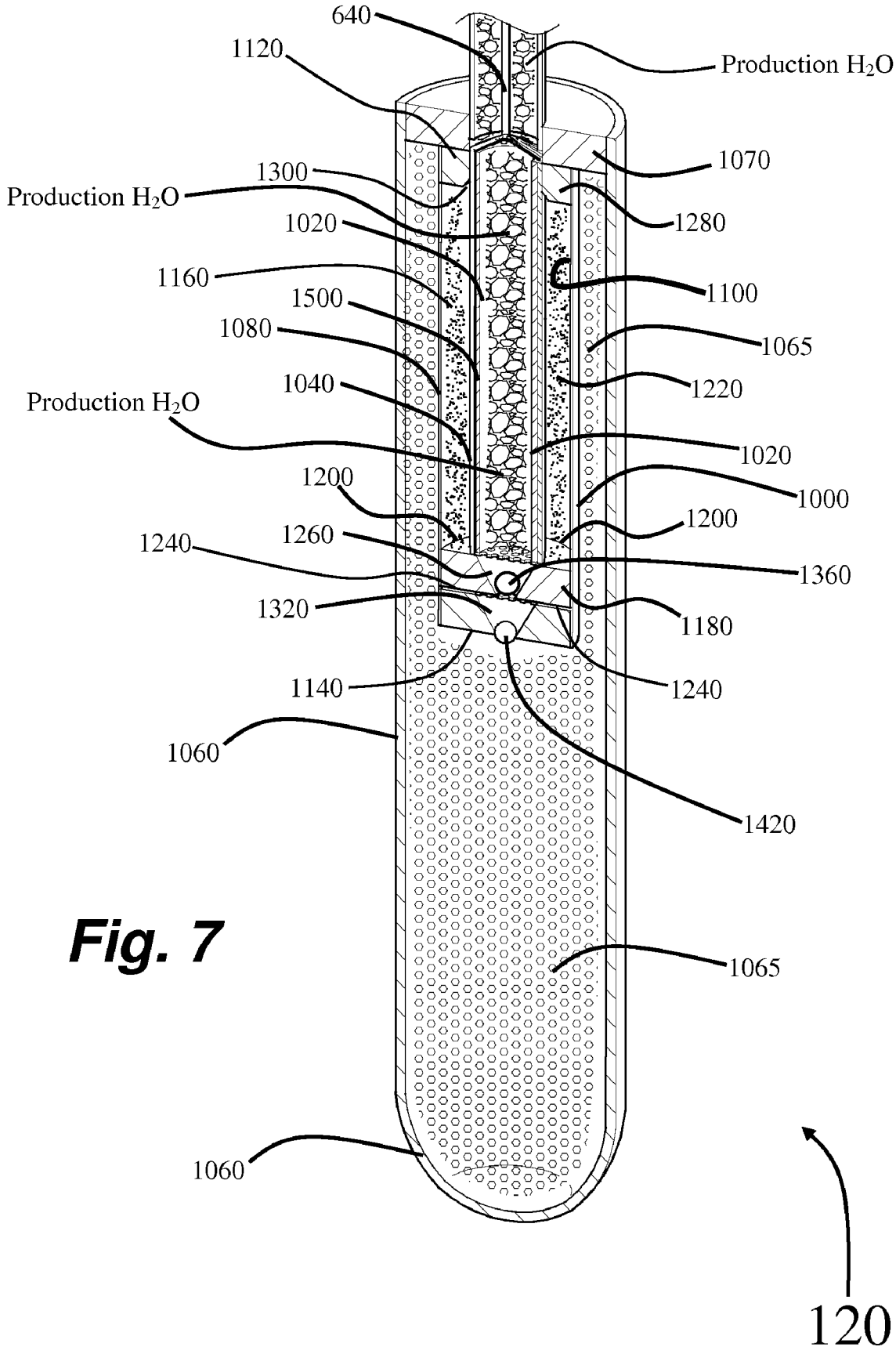
FIG. 7 shows the down-hole water pump of FIG. 3A at 100% completion of an upstroke.
Figure 8:
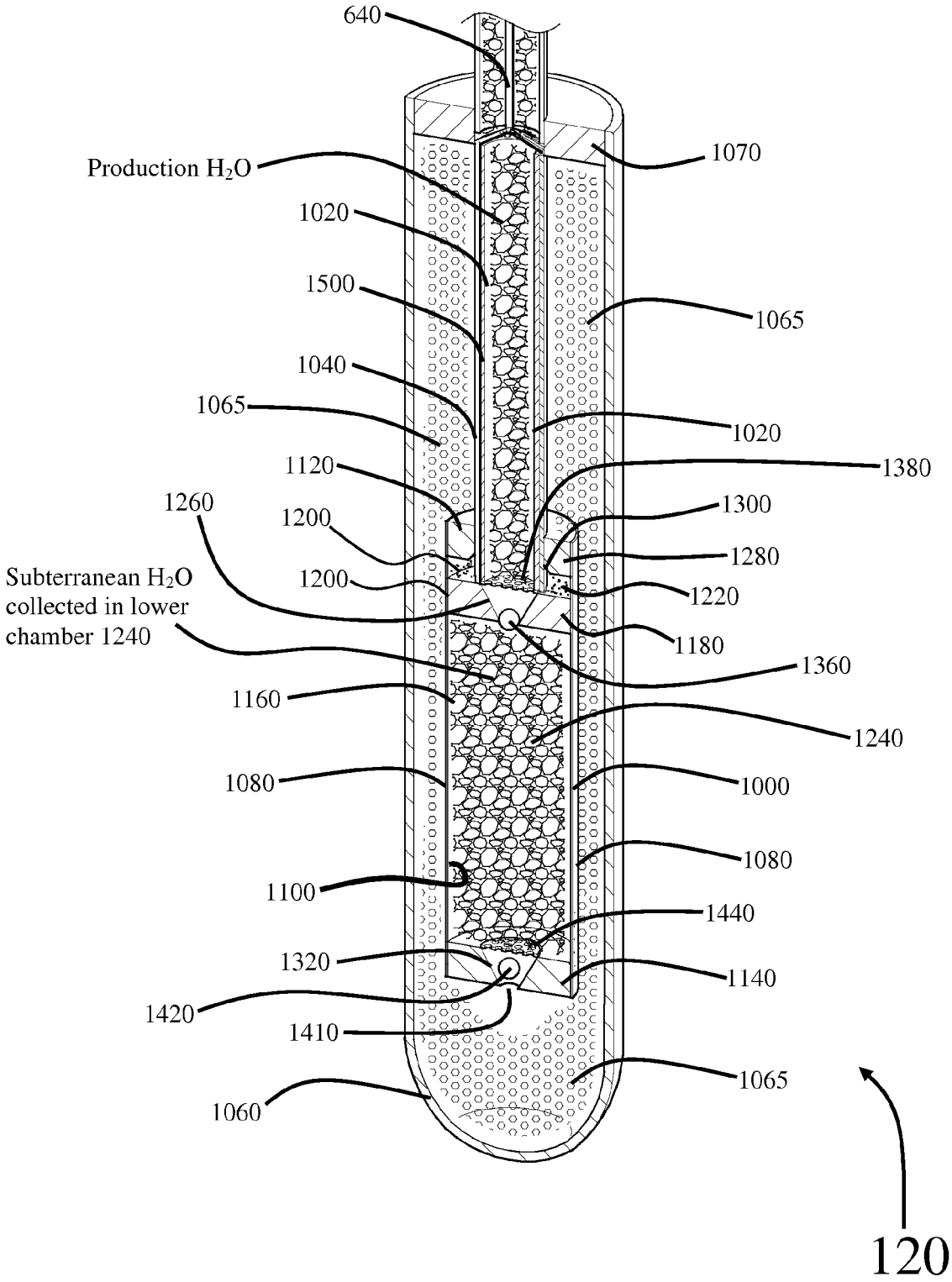
FIG. 8 shows the down-hole water pump of FIG. 3A just after the start of a down-stroke.

Referring to FIG. 3A, which shows a lengthwise cross-section view of the pump 120 according to the present invention, the pump 120 comprises a cylindrical housing 1000, a linear elongated inner-production-tube 1020, and a linear elongated outer-tube 1040. The pump 120 also includes an optional screen assembly 1060. The optional screen assembly 1060 preferably surrounds the cylindrical housing 1000, wherein the optional screen assembly 1060 defines a cavity 1065 around the housing 1000, during normal operation the cavity 1065 is typically full of subterranean water. In one embodiment, the optional screen assembly 1060 includes a top seal 1070. The exact design of the optional screen assembly 1060 can be any suitable shape so long as it surrounds the traveling check-valve 1320 (see, e.g., FIG. 3A) thereby screening subterranean water entering the lower chamber 1240 (shown in, e.g., FIG. 3A). The optional screen assembly 1060 is used to prevent particles above a predetermined size entering the pump 120 and otherwise interfering with or causing increased wear and tear during operation of the pump 120. The screen assembly 1060 has a suitable mesh size such as a mesh size ranging from about 40 mesh to about 150 mesh. The screen assembly 1060 may comprises one or more layers of mesh screen such as an outer and inner screen. If more than one mesh screen is used, the outermost mesh screen preferably allows larger particles through than the next inner mesh screen. It should be understood that the screen 1060 can be uniformly or partly covered in perforations.

Referring to FIGS. 4 through 9, the cylindrical housing 1000 defines a cylindrical sidewall 1080. The cylindrical sidewall 1080 defines an inner surface 1100. The cylindrical housing 1000 engages in reciprocal linear motion in the form of cycles of up-strokes and down-strokes in the vertical plane. The housing 1000 has opposite top 1120 and bottom 1140 ends with a cylindrical pump-bore 1160 therebetween. A dividing wall 1180 is disposed in the housing 1000, and more particularly the dividing wall 1180 is disposed coaxially inside pump-bore 1160; housing dividing wall 1180 defines upper and lower surfaces 1190 and 1195, respectively (see FIG. 6). The dividing wall 1180 defines an outer circular perimeter 1200. The inner surface 1100 of the cylindrical sidewall 1080 is in slidable engagement with the outer perimeter 1200 of dividing wall 1180. The dividing wall 1180 divides the pump-bore 1160 into an upper chamber 1220 and a lower chamber 1240 the volumes of which vary. More specifically, with each down-stroke of housing 1000 the upper chamber 1220 and lower chamber decrease and increase in volume respectively; and conversely for each upstroke of housing 1000 the upper chamber 1220 and lower chamber increase and decrease in volume respectively (see Table 1).

The dividing wall 1180 includes a standing check-valve 1260; the standing check-valve is integrated into the housing dividing wall 1180 (the terms "housing dividing wall 1180" and "dividing wall 1180" are regarded as equivalent terms). The top end 1120 of housing 1000 defines a cylinder head 1280. The cylinder head 1280 defines a cylindrical cylinder-head-bore 1300 therethrough and a lower cylinder head surface 1285. The cylindrical cylinder-head-bore 1300 is sized to accommodate the outer tube 1040, wherein the outer tube 1040 fits through the cylinder-head-bore 1300 and the cylinder head 1280 is in slidable engagement with the outer tube 1040; more specifically, the outer tube 1040 slides up and down through the cylindrical cylinder-head-bore 1300. As should now be apparent, housing 1000 is capable of performing up and down-strokes by being in slidable engagement with the outer tube 1000 and housing dividing wall 1180 and more specifically the outer perimeter 1200 of the housing dividing wall 1180.

A traveling check-valve 1320 is located in the bottom end 1140 of the housing 1000 such that the traveling check-valve 1320 is in operable communication with lower chamber 1240 such that during actual operation of pump 120 subterranean water located outside of housing 1000 is controllably allowed to enter the lower chamber 1240 via traveling check-valve 1320.

Figure 10:
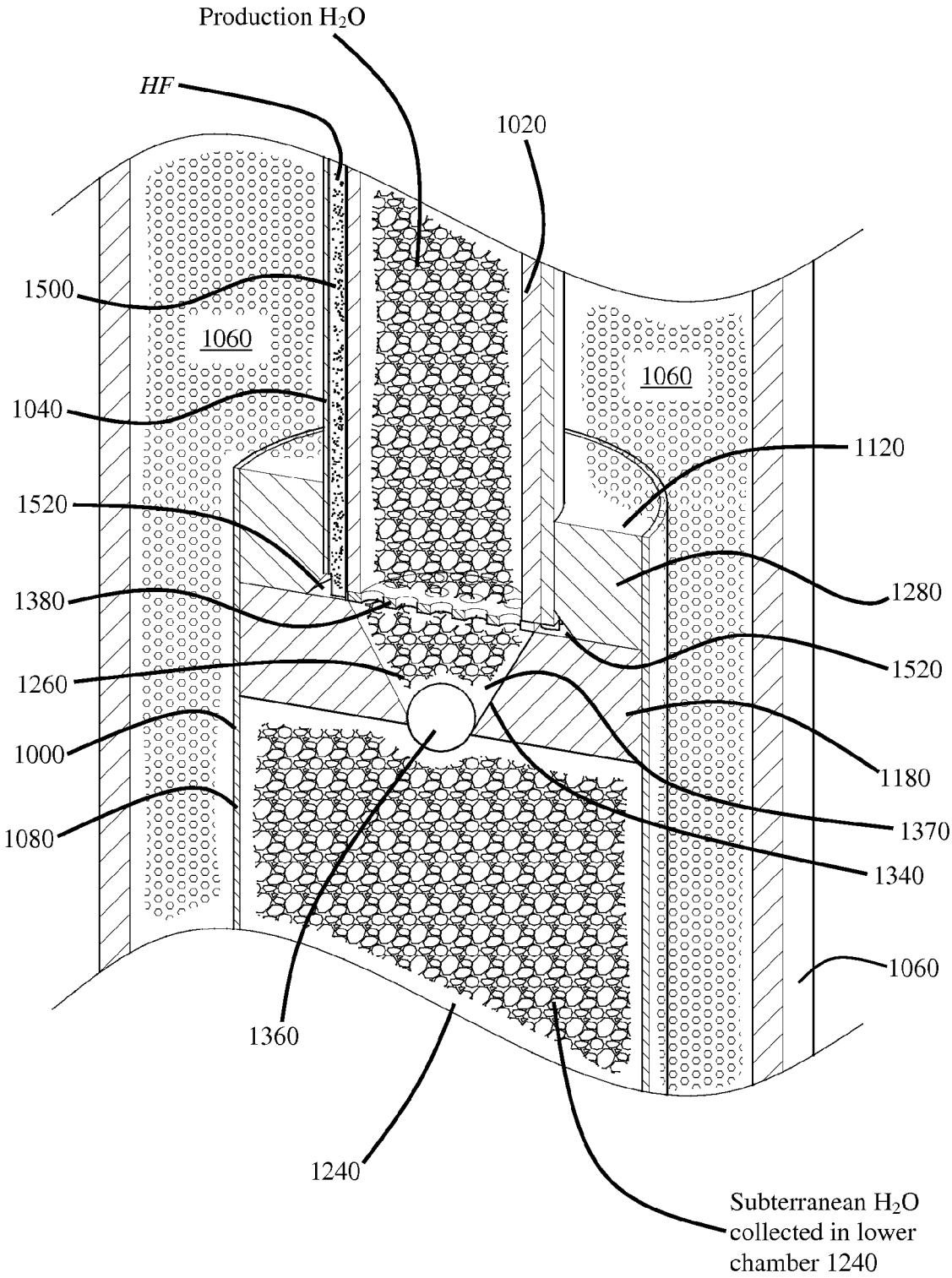
FIG. 10 shows a close up cross-section view of part of the down-hole pump shown in FIG. 4.
Figure 10A:
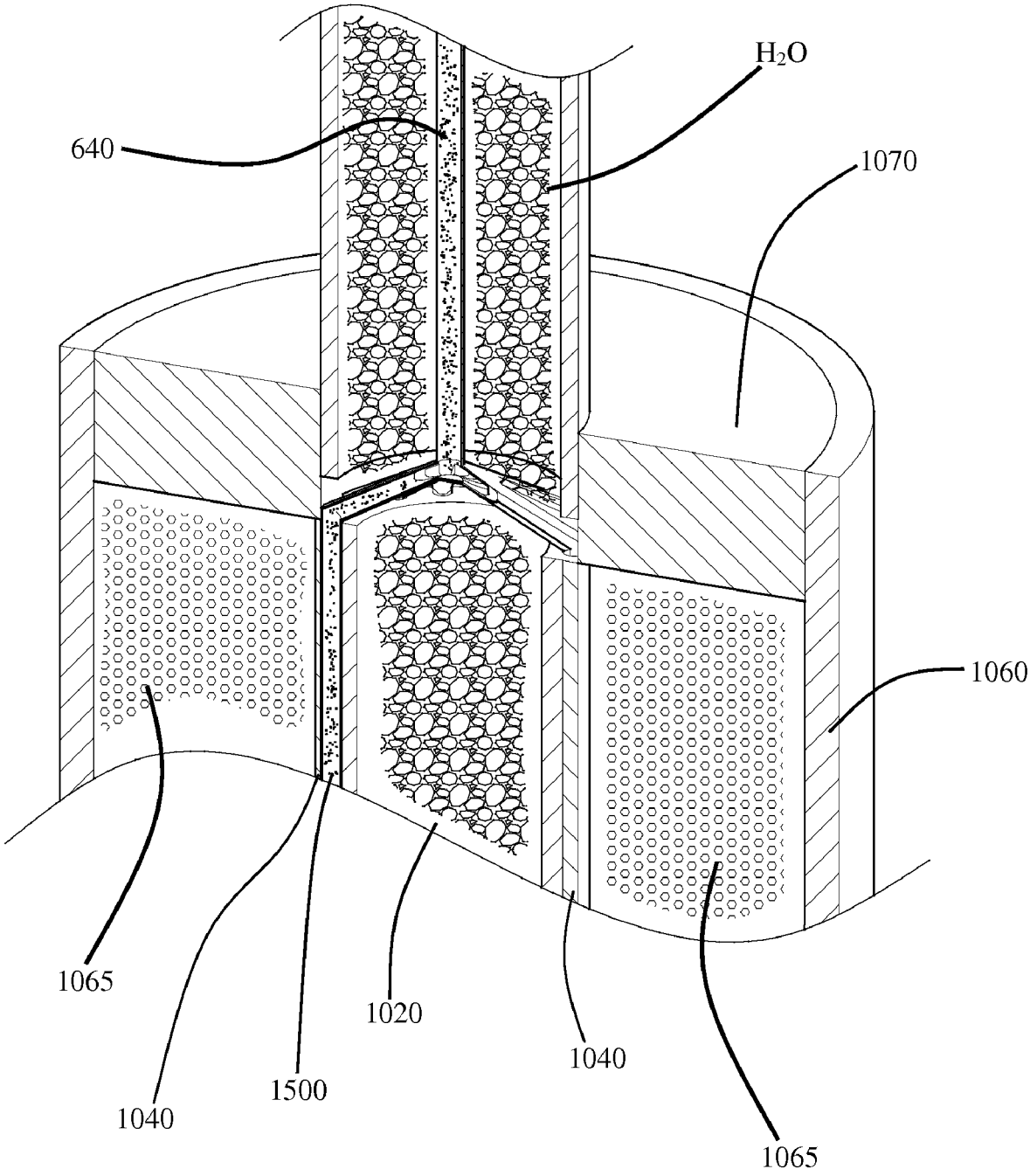
FIG. 10A shows a close up cross-section view of part of the down-hole pump of FIG. 3A.

Referring to FIG. 10, the standing check-valve 1260 comprises a standing check-valve seat 1340, standing check-valve aperture 1350, and standing check-valve ball 1360 moving in a standing check-valve cage 1370 defined by standing check-valve grill 1380.

Figure 9:
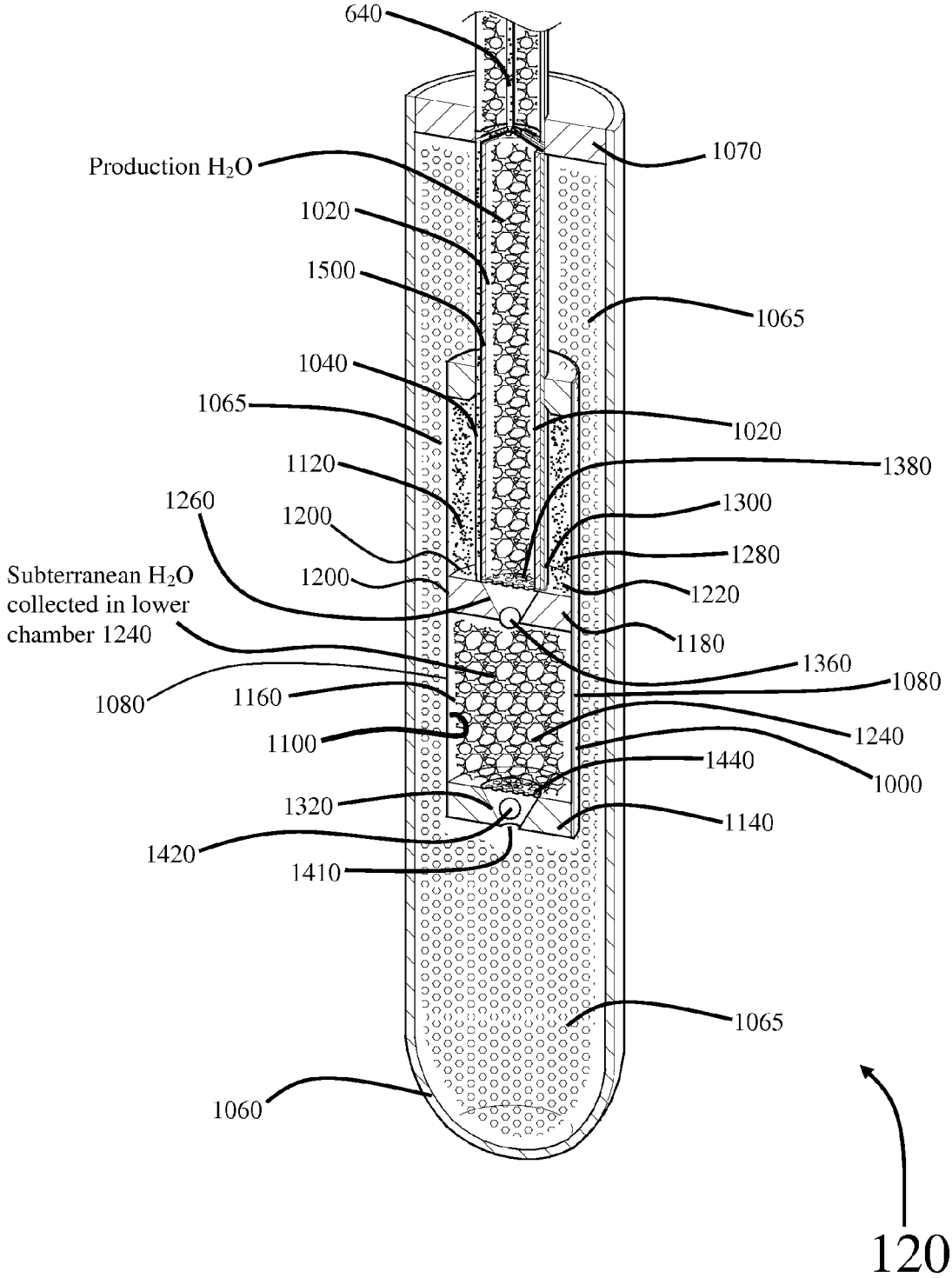
FIG. 9 shows the down-hole water pump of FIG. 3A at 50% completion of a down-stroke.
Figure 11:
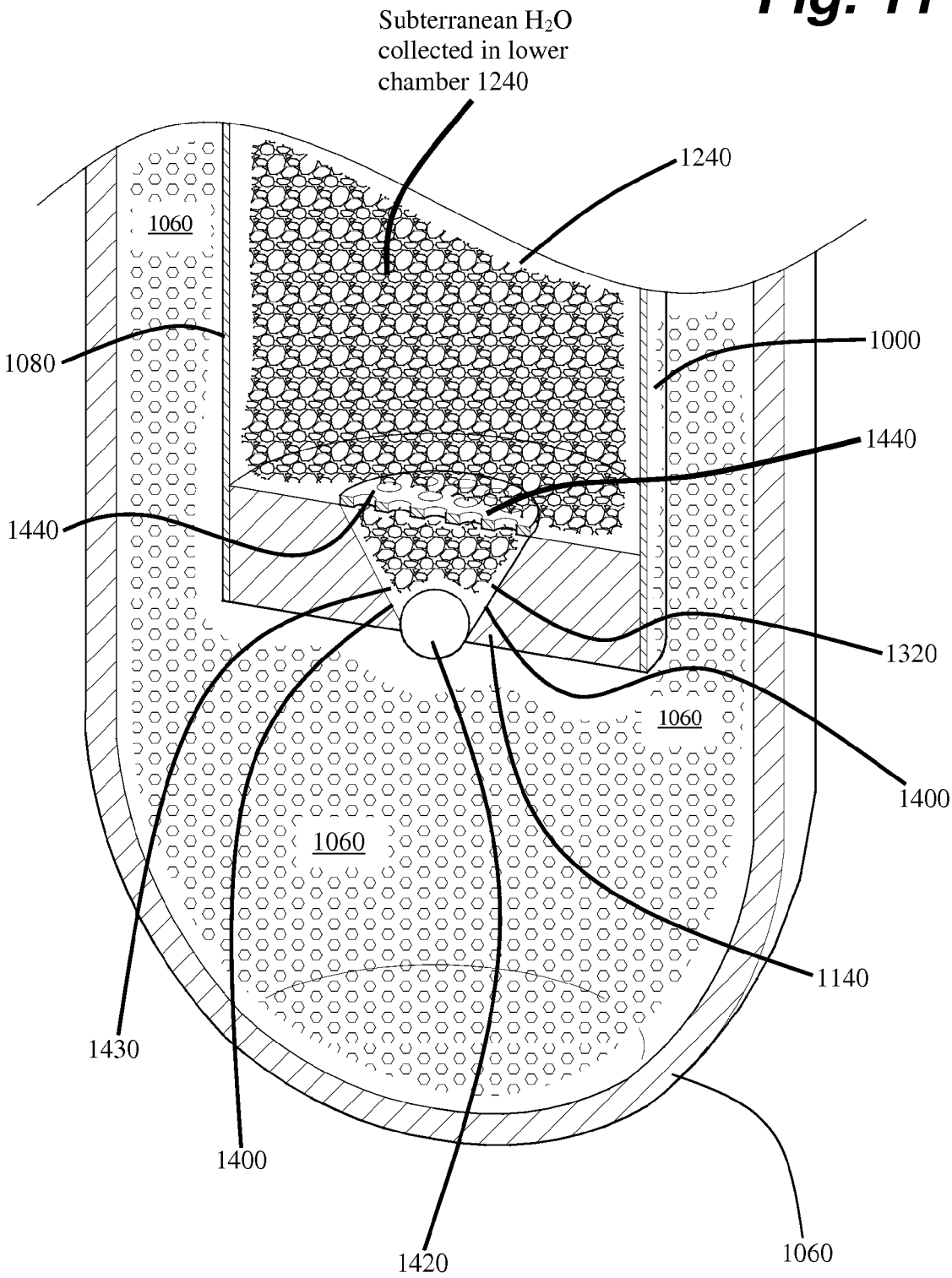
FIG. 11 shows a close up cross-section view of part of the down-hole pump of FIG. 3A.
Figure 11A:
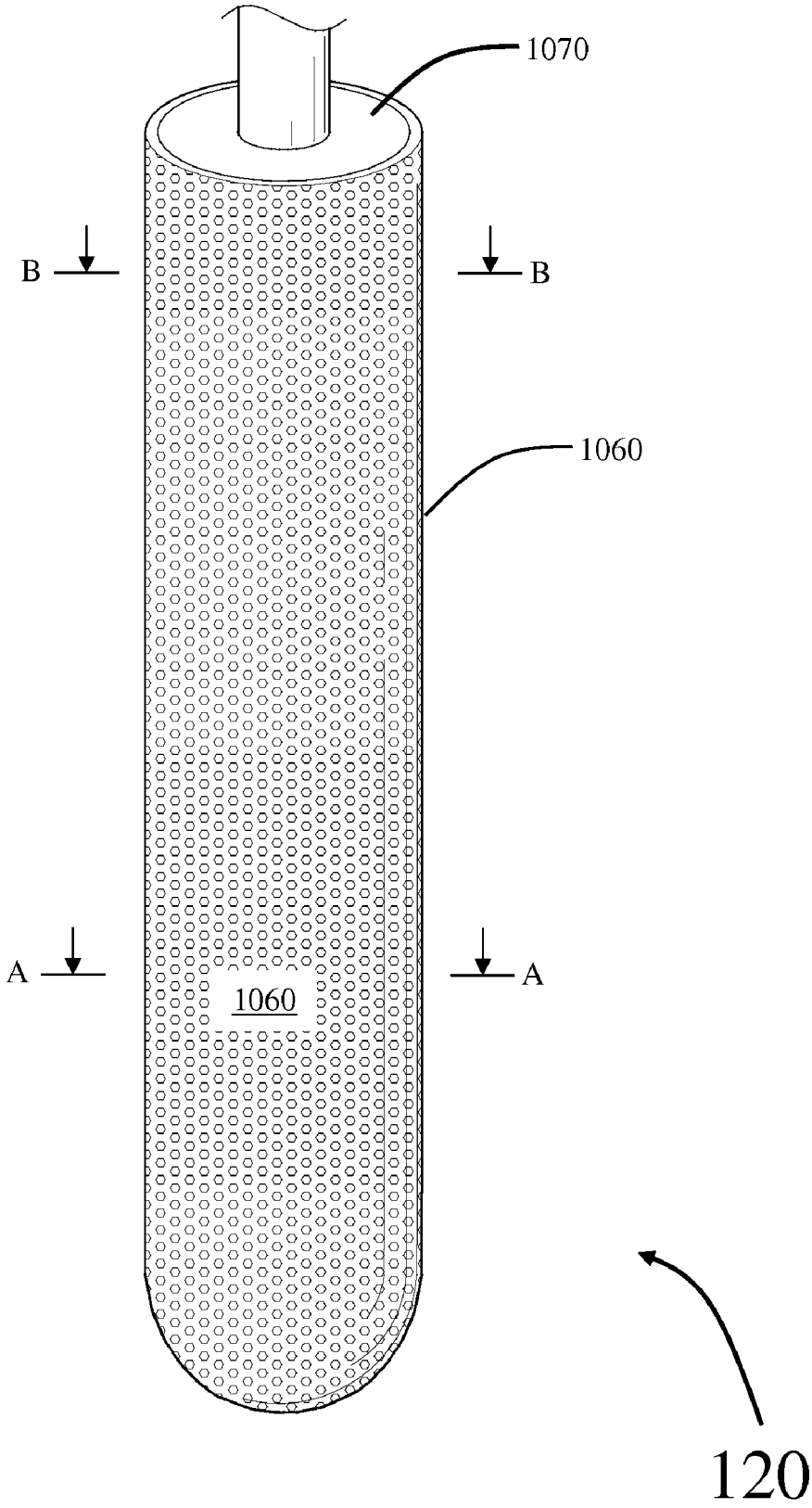
FIG. 11A shows an external view of the down-hole pump of FIG. 3A, wherein the down-hole pump housing (hidden from view in FIG. 11A) is in a 100% down-stroke position as shown in FIG. 4.
Figure 12:
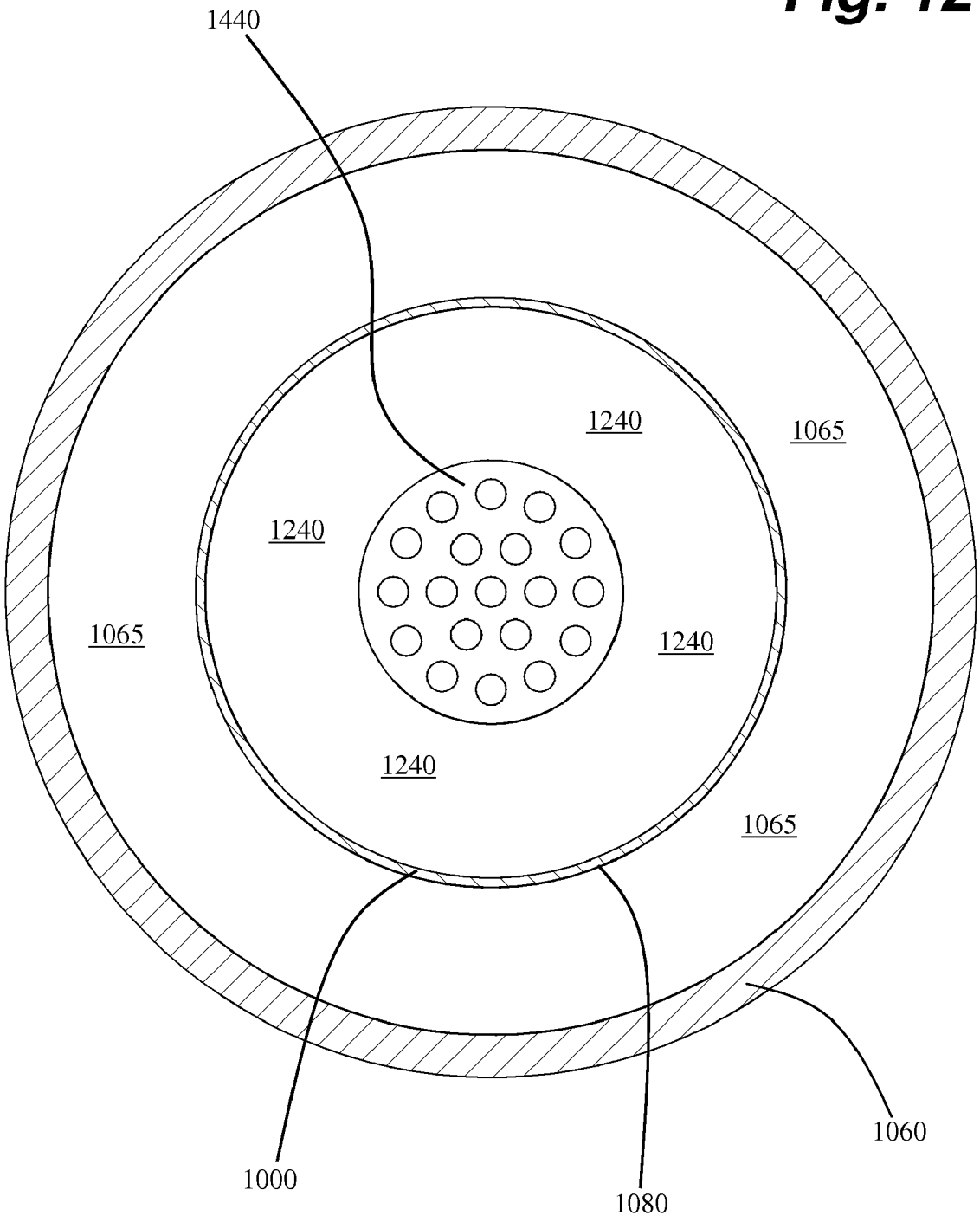
FIG. 12 shows a bottom section view from line A-A shown in FIG. 11A.

Referring to FIG. 11, the traveling check-valve 1320 comprises traveling check-valve seat 1400, traveling check-valve aperture 1410 (see FIG. 8), and traveling check-valve ball 1420 moving in a traveling check-valve cage 1430 defined by traveling check-valve grill 1440 (see, e.g., FIGS. 9 and 11).

During normal operation of pump 120 the standing check-valve is either in an open or closed state (see Table 1). More specifically, the standing check-valve ball 1360 is either blocking or not blocking standing check-valve aperture 1350. When the standing check-valve 1360 is blocking the standing check-valve aperture 1350 the standing check-valve aperture 1350 is in a closed state, and conversely when the standing check-valve 1360 is not blocking the standing check-valve aperture 1350 the standing check-valve aperture 1350 is in an open state. When the standing check-valve aperture 1350 is open state subterranean water collected in the lower chamber 1240 can pass into the inner-production-tube 1020 (see Table 1). During normal operation of pump 120 the inner-production-tube 1020 is operably connected to a water-tube string 1027 (i.e., sections of water piping, shown schematically in FIG. 1) that directs subterranean water from inner-production-tube 1020 to the surface for storage, treatment or dispersal.

During normal operation of pump 120 the traveling check-valve is either in an open or closed state (see Table 1). More specifically, the traveling check-valve ball 1420 is either blocking or not blocking traveling check-valve aperture 1410 (see FIGS. 8 and 9). When the traveling check-valve ball 1420 is blocking the traveling check-valve aperture 1410 the traveling check-valve aperture 1410 is in a closed state, and conversely when the traveling check-valve ball 1420 is not blocking the traveling check-valve aperture 1410, the traveling check-valve aperture 1410 is in an open state. When the traveling check-valve aperture 1410 is in an open state subterranean water can enter the lower chamber 1240 (see Table 1).

The traveling check-valve 1320 travels up and down with housing 1000 of pump 120, and more specifically travels, with each up and down stroke, with the bottom 1140 of housing 1000. Balls 1360 and 1420 can be made out of any suitable material such as a metal or metal alloy that is denser than water. Grills 1380 and 1440 (see FIG. 9) allow easy passage of water therethrough but prevent balls 1360 and 1420 from escaping their respective cages 1370 and 1430, see FIGS. 14 and 15. It will be understood by a person of ordinary skill in the art that standing and traveling check-valves 1260 and 1320 respectively can be designed in any number of suitable ways without detracting from the spirit of the claimed invention.

Standing and traveling apertures 1350 and 1410 (see FIGS. 6 and 8, respectively) are respectively open and closed during each upstroke of housing 1000; conversely, standing and traveling apertures 1350 and 1410 are respectively closed and open during each down-stroke of housing 1000. More specifically, during an upstroke of housing 1000 the pressure inside lower-chamber 1240 increases and forces aperture 1410 closed and aperture 1350 open thereby forcing water from the lower chamber 1240 into the inner-production-tube 1020; conversely, during a down-stroke of housing 1000 the pressure inside lower-chamber 1240 decreases and forces aperture 1350 closed and aperture 1410 open thereby allowing subterranean water to flow into and collect in lower chamber 1240 ready for the next upstroke of housing 1000 (see Table 1).

Figure 13:
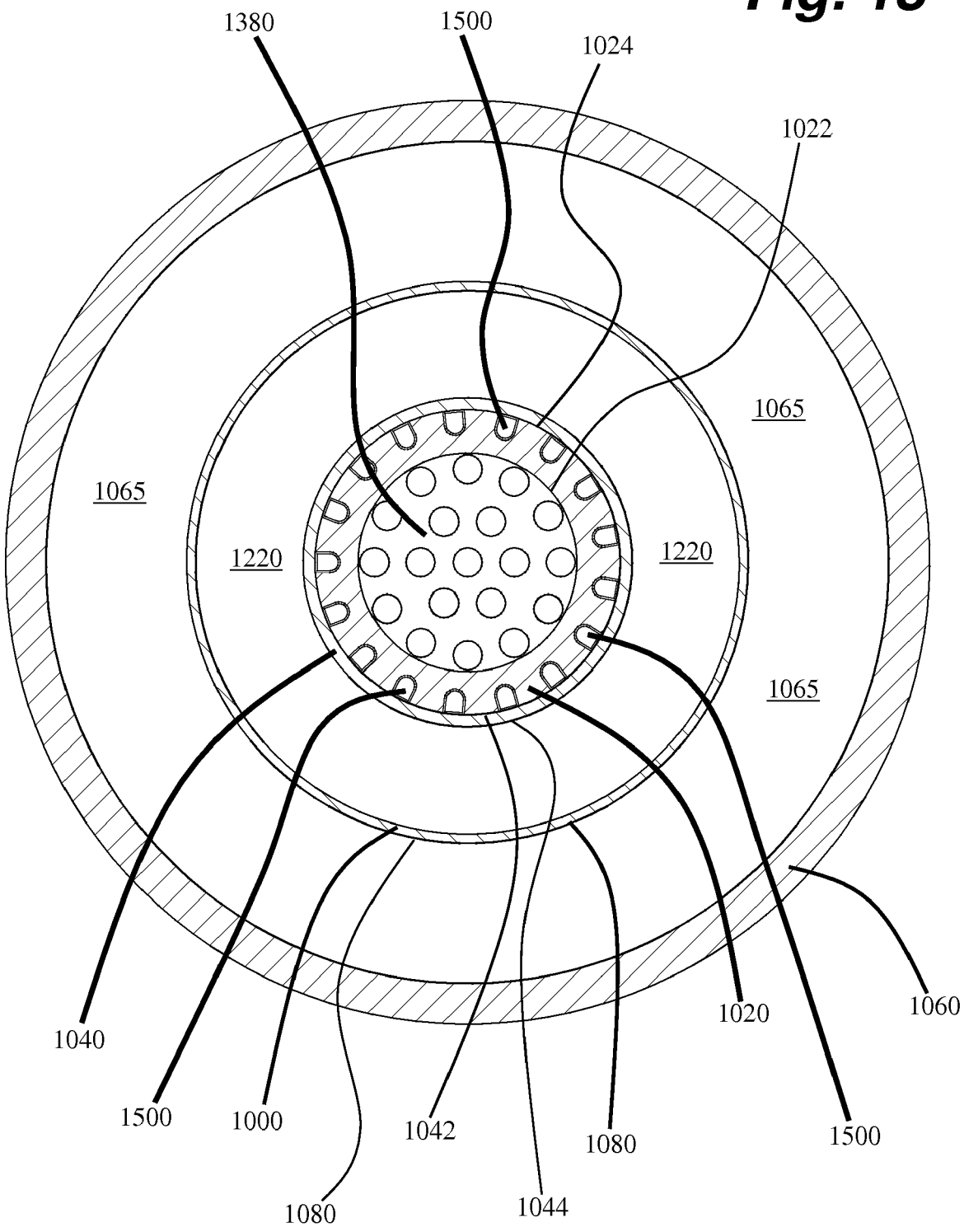
FIG. 13 shows a top section view from line B-B shown in FIG. 11A.
Figure 14:
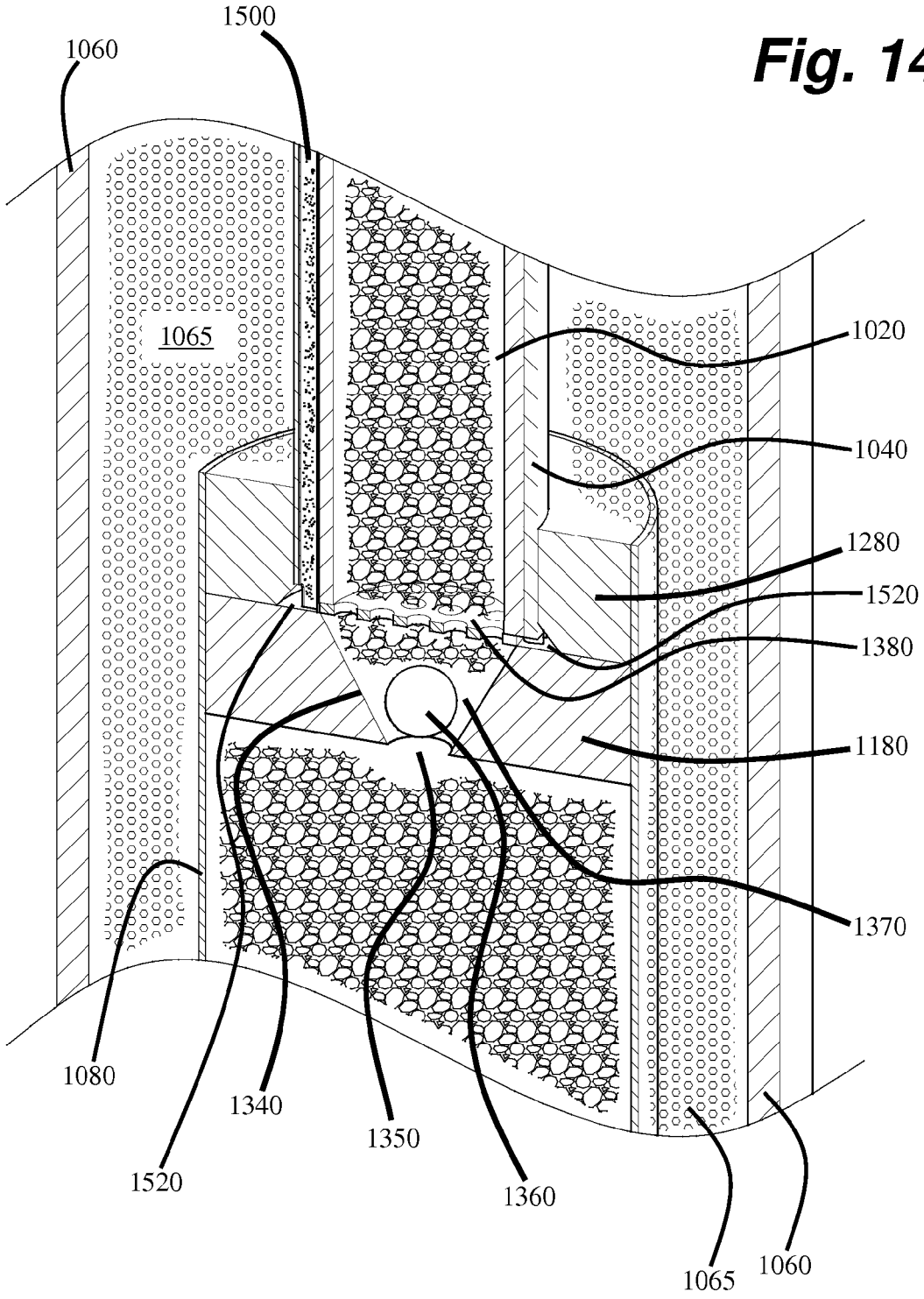
FIG. 14 shows a close up cross-section view of part of the down-hole pump of FIG. 3A.
Figure 15:
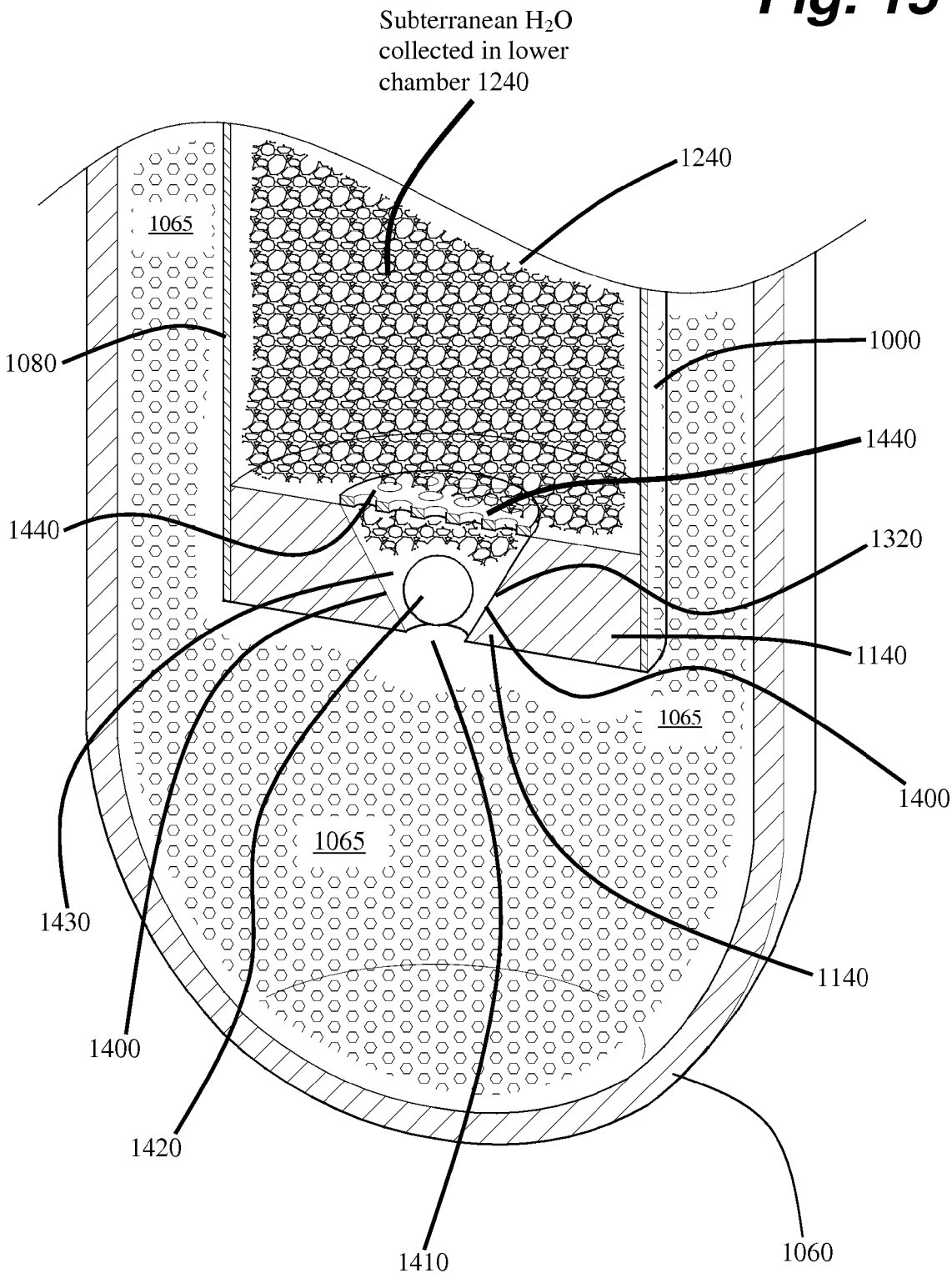
FIG. 15 shows a close up cross-section view of part of the down-hole pump of FIG. 3A.
Figure 16:
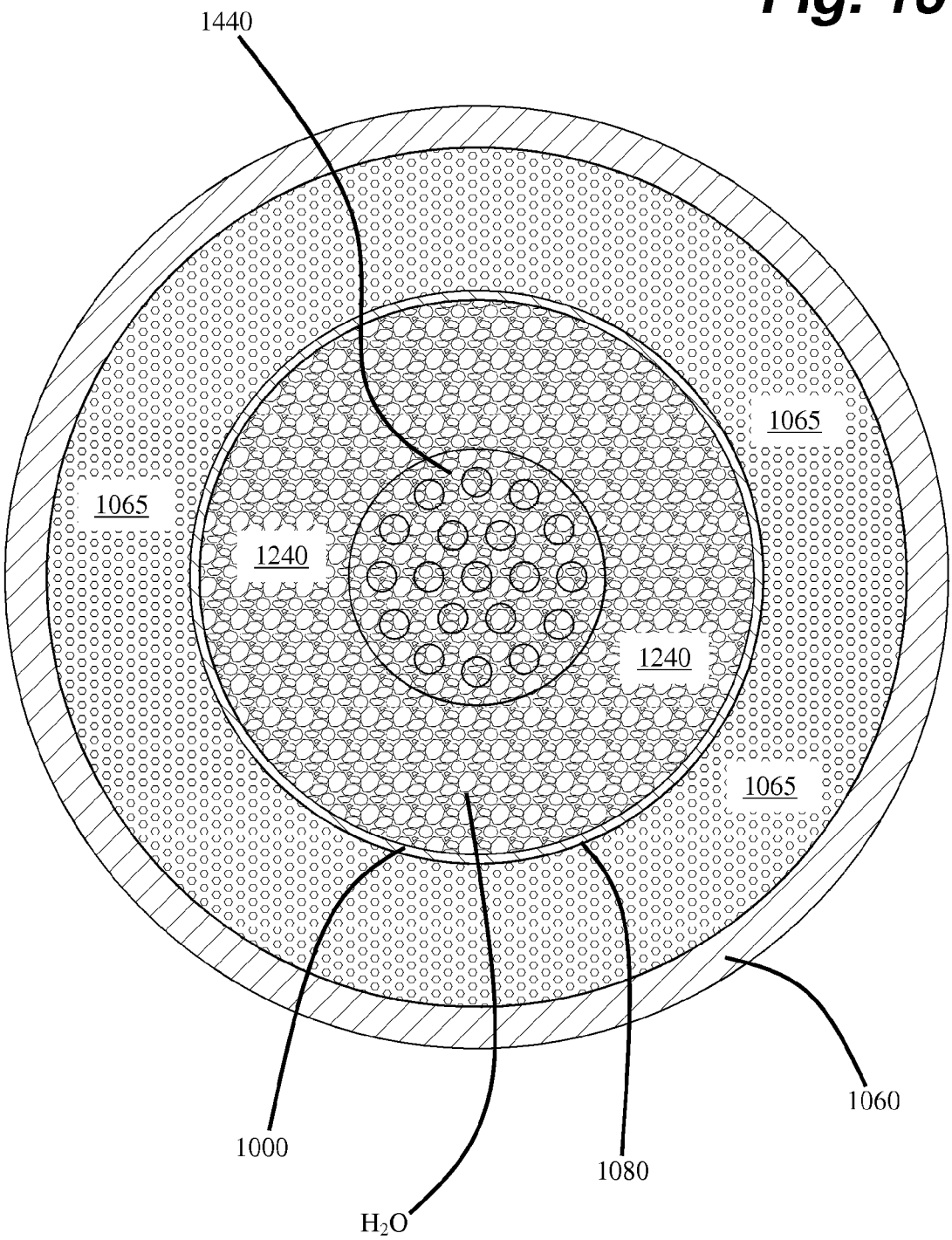
FIG. 16 shows the bottom section view of FIG. 12 with water shown inside a lower chamber.
Figure 17:
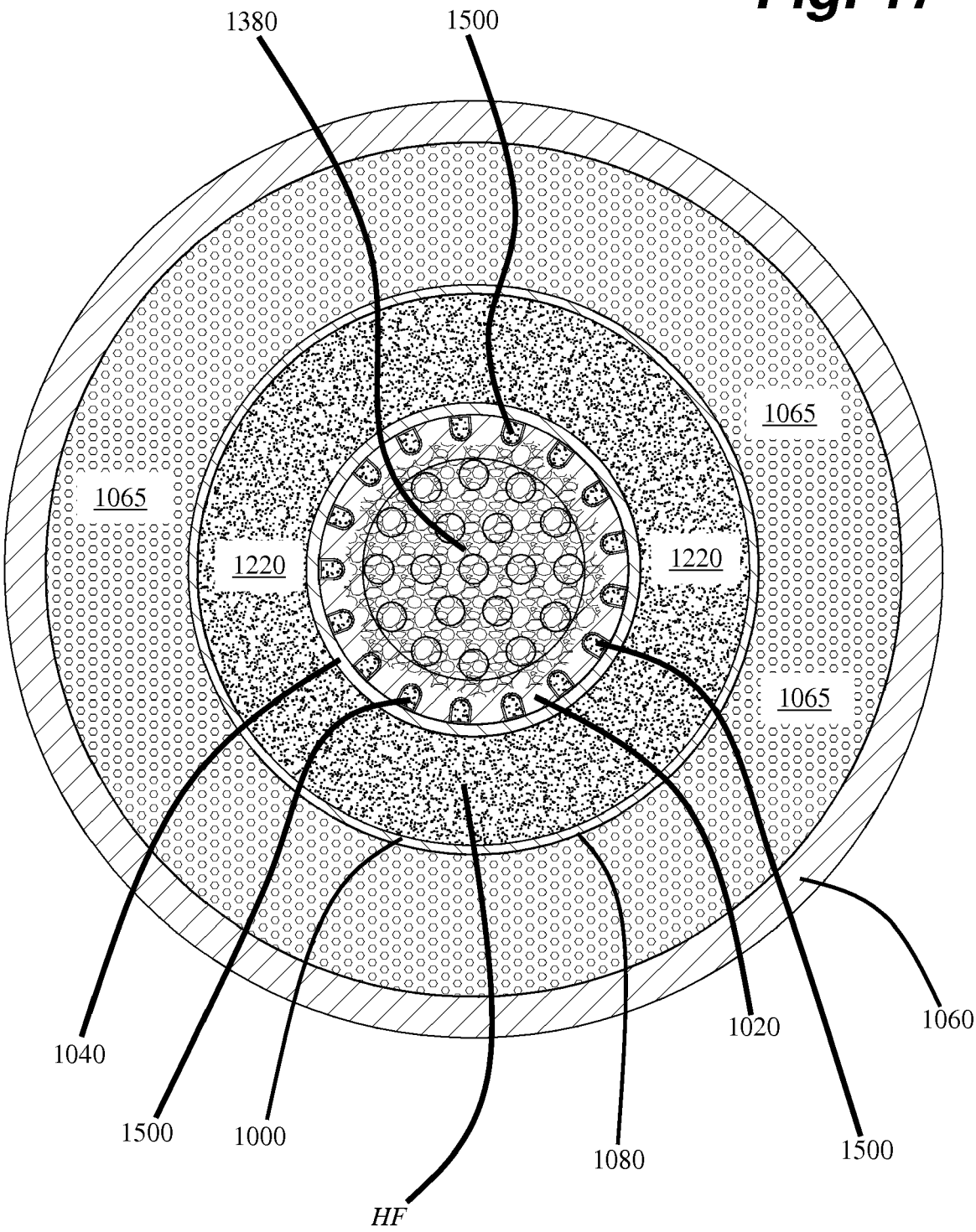
FIG. 17 shows the top section view of FIG. 13 with hydraulic fluid shown inside an upper chamber.

Outer tube 1040 defines interior and exterior surfaces 1042 and 1044, respectively (see FIG. 13). Inner-production-tube 1020 defines interior and exterior surfaces 1022 and 1024, respectively (see FIG. 13). A plurality of channels 1500 (see, e.g. FIG. 13) of predetermined length are cut into the exterior surface 1024 of inner-production tube 1020 such that the channels 1500 are parallel to the longitudinal axis of the inner-production-tube 1020. The channels 1500 are in operable communication with the upper chamber 1220 and are used to facilitate the passage of hydraulic fluid HF pumped from driving fluid chamber 620 by piston 380 (see FIG. 1) to upper chamber 1220 in submersible pump 120. The interior surface 1042 of outer tube 1040 (see FIG. 6) serves to substantially prevent leakage of hydraulic fluid from the channels 1500.

Figure 18:
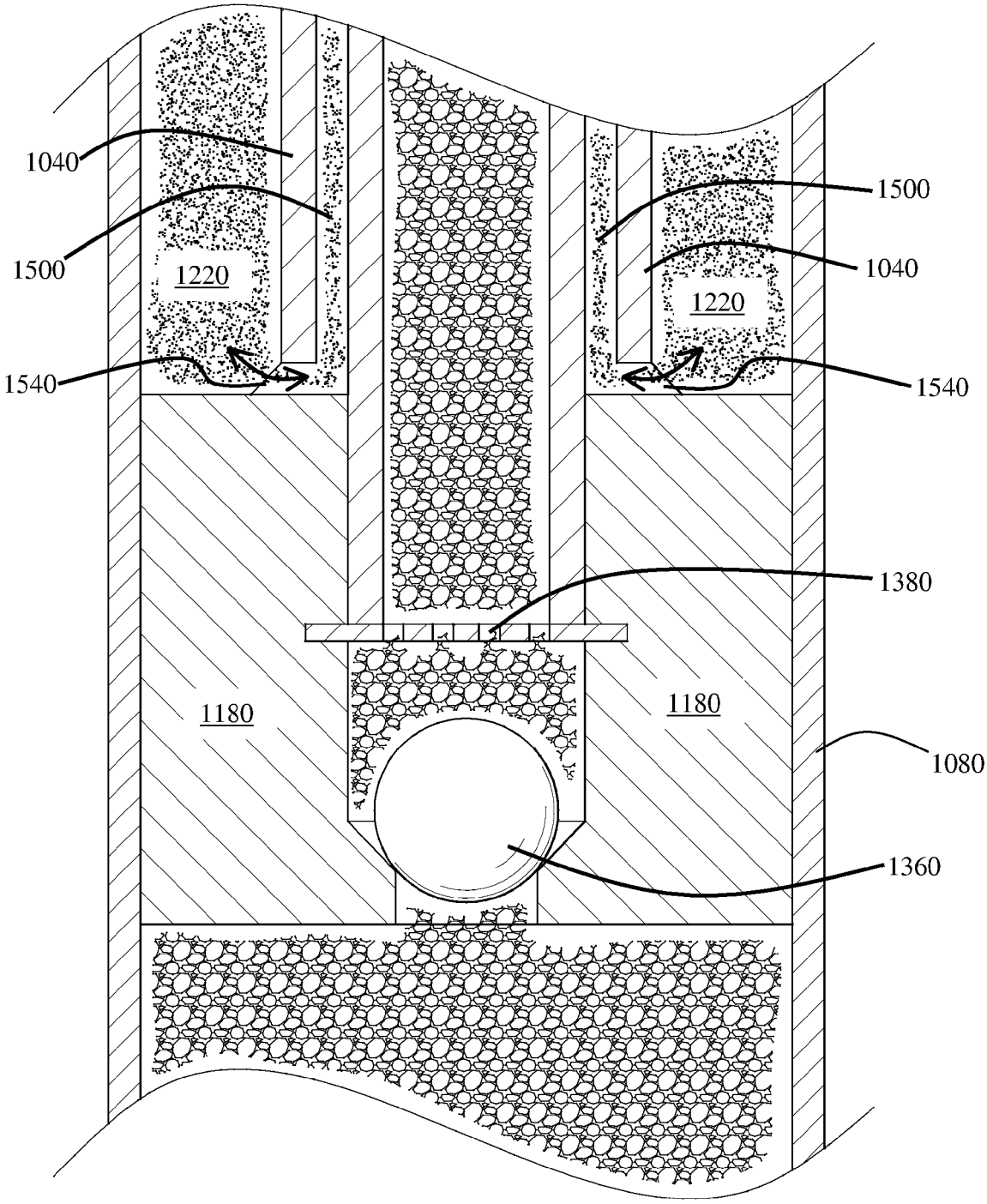
FIG. 18 shows a close up view of one embodiment of the standing check-valve part of a pump according to the present invention.

An optional circular cut-away 1520 (see FIG. 14) is disposed in the horizontal plane in the lower surface 1285 (see FIG. 6) of cylinder head 1280. The optional cut-away 1520 facilitates passage of hydraulic fluid from channels 1500 to help push up cylinder head 1280 (and hence housing 1000 of which cylinder head 1280 forms an integral part thereof) away from stationary housing dividing wall 1180. If present, optional cutaway 1520 forms part of the upper chamber 1220 such that if the lower surface 1285 of the cylinder head 1280 abuts directly against the upper surface 1190 (see FIG. 6) of the housing dividing wall 1180 the cut-away 1520 acts as a circular horizontal passageway for hydraulic fluid to push against the top side of the housing dividing wall 1180. Alternatively, the channels 1500 can define a channel port 1540 (see FIG. 18) wherein hydraulic fluid can be directed to/from channels 1500 into/from upper chamber 1220 as indicated by two-way arrows shown at the entrance to the channel ports 1540 shown in FIG. 18.

It is to be understood that the present invention is not limited to the embodiments described above, but encompasses any and all embodiments deemed within the scope of the following claims.

TABLE 1

| Status | Standing check-valve 1260 | Traveling check-valve 1320 | Upper chamber 1220 of pump 120 | Lower chamber 1240 of pump 120 | Position and/or direction of piston 380 in second cylinder bore 320 of flow converter 130 |
|---|---|---|---|---|---|
| At 100% down-stroke position of housing 1000 (see FIG. 4) | closed | closing | Substantially empty of hydraulic fluid ($V_U$ at lowest stroke volume value) | At maximum capacity of collected subterranean water ($V_L$ at highest stroke volume value) | Aligned proximate to side 430 of flow converter dividing wall 340 |
| Just after start of upstroke of housing 1000 (see FIG. 5) | opening or open | closing or closed | Starting to fill with hydraulic fluid delivered via line 640 ($V_U$ increasing) | Starting to empty of subterranean water ($V_L$ decreasing) | Moving away from side 430 |
| At 50% completion of upstroke of housing 1000 (see FIG. 6) | open | closed | Still filling with hydraulic fluid delivered via line 640 ($V_U$ at 50% of maximum stroke volume | Still emptying of subterranean water ($V_L$ at 50% of maximum stroke volume value) | Moving towards base end 460 and positioned approximately midway between side 430 and base end 460 |
| At 100% of upstroke position of housing 1000 (see FIG. 7) | closing | closed | Substantially full of hydraulic fluid ($V_U$ at highest volume value) | At lowest capacity of collected subterranean water ($V_L$ at lowest stroke volume value) | Aligned proximate to base end 460 |
| Just after start of down-stroke of housing 1000 (see FIG. 8) | closed | opening or open | Starting to empty of hydraulic fluid ($V_U$ decreasing) | Starting to fill with collected subterranean water ($V_L$ increasing) | Moving away from base end 460 |
| At 50% completion of down-stroke of housing 1000 (see FIG. 9) | closed | open | Still emptying of hydraulic fluid ($V_U$ at 50% of maximum stroke volume value) | Still filling with collected subterranean water ($V_L$ at 50% of maximum stroke volume value) | Moving towards side 430 of flow converter dividing wall 340 and positioned approximately midway between base end 460 and side 430 |

Where $V_U$ represents the changing volume of the upper chamber 1220 during repeating up and down strokes of housing 1000
Where $V_L$ represents the changing volume of the lower chamber 1240 during repeating up and down strokes of housing 1000

I claim:

1. A submersible water pump, comprising:

a cylindrical housing, said cylindrical housing defining a cylindrical sidewall and a cylindrical pump-bore, said cylindrical sidewall defining an inner surface, said cylindrical housing having opposite top and bottom ends with a housing dividing wall disposed coaxially between said top and bottom ends of said cylindrical housing, said top end of housing defines a cylinder head, said cylinder head defines a cylindrical cylinder-head-bore therethrough, said housing dividing wall defines a perimeter, wherein said bottom end of said housing includes a traveling check valve, said housing dividing wall includes a standing check valve, wherein said inner surface of said cylindrical sidewall is in slidable engagement with said perimeter of said housing dividing wall, wherein said housing dividing wall divides said cylindrical pump-bore into upper and lower chambers;

an inner tubing means for removing water from said lower chamber;

a channel means incorporated into said inner tubing means, said channel means being in operable communication with said upper chamber, wherein during normal operation said channel means cyclically supplies and removes hydraulic fluid from said upper chamber; and an outer tube, wherein said inner tubing means fits coaxially inside said outer tubing means, wherein said cylindrical cylinder-head-bore is sized to accommodate said outer tube, wherein said outer tube fits through said cylinder-head-bore and said cylinder head is in slidable engagement with said outer tube, wherein during normal operation said cylindrical housing engages in reciprocal linear motion in the form of cycles of up-strokes and down-strokes in the vertical plane while said housing dividing wall remains stationary.

2. The submersible water pump according to claim 1 further comprising a screen assembly for preventing particulates of a predetermined size range from entering said water pump via said traveling check valve.

3. A dewatering system suitable for dewatering coal bed methane wells, comprising:

a flow converter;

a hydraulic pump;

an electric motor;

a controller; and a submersible water pump, said pump comprising:

a cylindrical housing, said cylindrical housing defining a cylindrical sidewall and a cylindrical pump-bore, said cylindrical sidewall defining an inner surface, said cylindrical housing having opposite top and bottom ends with a housing dividing wall disposed coaxially between said top and bottom ends of said cylindrical housing, said top end of housing defines a cylinder head, said cylinder head defines a cylindrical cylinder-head-bore therethrough, said housing dividing wall defines a perimeter, wherein said bottom end of said housing includes a traveling check valve, said housing dividing wall includes a standing check valve, wherein said inner surface of said cylindrical sidewall is in slidable engagement with said perimeter of said housing dividing wall, wherein said housing dividing wall divides said cylindrical pump-bore into upper and lower chambers, an inner tubing means for removing water from said lower chamber, a channel means incorporated into said inner tubing means, said channel means being in operable communication with said upper chamber, wherein during normal operation said channel means cyclically supplies and removes hydraulic fluid from said upper chamber, and an outer tube, wherein said inner tubing means fits coaxially inside said outer tubing means, wherein said cylindrical cylinder-head-bore is sized to accommodate said outer tube, wherein said outer tube fits through said cylinder-head-bore and said cylinder head is in slidable engagement with said outer tube, wherein during normal operation said cylindrical housing engages in reciprocal linear motion in the form of cycles of up-strokes and down-strokes in the vertical plane while said housing dividing wall remains stationary.

4. The dewatering system according to claim 1 further comprising a screen assembly for preventing particulates of a predetermined size range from entering said submersible water pump via said traveling check valve.

* * * * *